US006817728B2

(12) United States Patent
Goko

(10) Patent No.: US 6,817,728 B2
(45) Date of Patent: Nov. 16, 2004

(54) TRIGGER APPARATUS OF A GUN THAT PROJECTS LIGHT

(75) Inventor: Junichi Goko, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/449,033

(22) Filed: Jun. 2, 2003

(65) Prior Publication Data

US 2004/0035041 A1 Feb. 26, 2004

(30) Foreign Application Priority Data

Jun. 7, 2002 (JP) ..... 2002-167832

(51) Int. Cl.[7] ..... F41G 1/35

(52) U.S. Cl. ..... 362/111; 42/69.01; 42/114; 42/117; 42/146; 463/49

(58) Field of Search ..... 42/69.01–69.03, 42/113, 114, 117, 146; 89/136; 362/110–114; 463/49, 51

(56) References Cited

U.S. PATENT DOCUMENTS 3,950,876 A * 4/1976 Wild et al. ..... 42/69.02
4,662,098 A * 5/1987 Timari ..... 42/69.01
5,709,046 A * 1/1998 Canaday ..... 42/69.01
6,651,642 B1 * 11/2003 Powers ..... 124/35.2

FOREIGN PATENT DOCUMENTS

CH 348078 * 9/1960 ..... 42/69.02
DE 200 10 929 U1 5/2001

OTHER PUBLICATIONS

U.S patent application No. 10/455, 449; pp. 1–41; Fig. 1–21; Filed on Jun. 6, 2003; not yet issued.

* cited by examiner

*Primary Examiner*—Stephen M. Johnson
(74) *Attorney, Agent, or Firm*—Young & Thompson

(57) ABSTRACT

A trigger apparatus of a light gun includes a main body, first to third rotation axes, a hammer receiving portion, and first to fourth lever portion. The first to third rotation axes are provided for the main body, a hammer receiving portion is provided in an upper portion of the main body. The first lever portion extends from the main body. The second lever portion is rotatably supported by the first rotation axis. The third lever portion is rotatably supported by the second rotation axis. The fourth lever portion is rotatably supported by the third rotation axis.

25 Claims, 12 Drawing Sheets

TRIGGER APPARATUS OF A GUN THAT PROJECTS LIGHT

BACKGROUND OF THE INVENTION

1. Field of the Invention

The present invention relates to a trigger apparatus of a light gun.

2. Description of the Related Art

A shooting game is one of games of the Olympics, and the shooting game is classified into two kinds of games, i.e., a pistol game and a rifle game. The pistol game is on the extension of shooting training of a policeman and promotes shooting training effectively. An actual bullet is used in the game and the training. The use of the actual bullet is not desirable in the viewpoint of expense and safety, and it is desirable to use a light bullet such as a short-wavelength laser beam shot in place of the actual bullet. When the light bullet is used in place of the actual bullet, it is necessary to change the trigger apparatus of the gun.

FIG. 1 shows an example of a trigger apparatus of a conventional gun using the actual bullet. In FIG. 1, a barrel unit is excluded from the gun. The trigger apparatus is composed of a grip portion 101 and a trigger system fixed portion 102. A trigger operating portion 104 is rotatably attached to a main axis 103 arranged in a bottom portion of the trigger system fixed portion 102. The trigger operating portion 104 is composed of a trigger lever 105 rotatably coupled with the main axis 103, and a trigger blade 106 attached to the trigger lever 105. A trigger driven portion 107 carries out a rotating operation in conjunction with the operation of the trigger operating portion 104. The trigger driven portion 107 is composed of a first driven lever 108, a second driven lever 109 and a third driven lever 110. The first driven lever 108 is formed as a unit together with the trigger lever 105 and rotates around the main axis together with the trigger lever 105. The second driven lever 109 operates in conjunction with the first driven lever 108 but not formed as a unit with the first driven lever 108. The third driven lever 110 operates in conjunction with the first driven lever 108 but not formed as a unit with the second driven lever 109. The second driven lever 109 and the third driven lever 110 are rotatably supported by rotation axes different from each other. With the angular displacement in the neighborhood of the top dead point of each of the second driven lever 109 and the third driven lever 110, the third driven lever 110 rotates by a small angle so that a hammer section 112 stopped or fixed by the third driven lever 110 is released from the stopped position and starts to move in a moment in spring power. Thus, the actual bullet is shot through the explosion of gunpowder due to impact of the hammer 112.

FIG. 2 shows a conventional pistol-type light gun. The pistol-type light gun is composed of a grip 201 of wood, a barrel unit 202 which is attached to and supported by the grip 201, a trigger 203 arranged in a coupling region between the grip 201 and the barrel 202, a cocking lever 204 as a lever used to return the trigger, a front side gun sight 205 arranged in the front position of the barrel unit, and a back side gun sight 206.

The pistol-type light gun is held by one hand of a shooter in the state that his arm extends into a target direction, the shooter sets his sight on target using cross lines of the gun sights 205 and 206 while restraining the fluctuation of his arm, and then a light bullet is shot toward the target by pulling the trigger 203 with his finger. The trigger 203 gives the reaction of a proper degree to the finger of the shooter in case of the pulling operation. When the reaction in case of the pulling operation is too weak, a relation between the trigger operation and the shooting operation of the light bullet is non-sensitive, and there is a danger that the light bullet is shot carelessly. When the reaction in case of the pulling operation is too strong, the barrel fluctuates in case of the trigger operation. As a result, the light bullet does not hit the target set using the gun sights. The actual bullet gun and the light bullet gun do not have an essential difference in the trigger operation and the reaction operation.

The reaction force corresponding to a dynamic displacement at the moment of the trigger operation acts on the finger, the arm (in case of the pistol) or the shoulder (in case of the rifle) of the shooter. The existence of such reaction becomes the cause of the necessity of the shooting training and is also the cause of the existence of the shooting game.

It is demanded to provide a special trigger apparatus for a light gun since an actual bullet is not shot from the light gun and reaction force is not present in the shooting operation of the light bullet. Also, the simplification of the trigger apparatus is demanded for the shooting game.

SUMMARY OF THE INVENTION

Therefore, an object of the present invention is to provide a trigger apparatus of a light gun in which a trigger system is like the trigger system of an actual bullet gun.

Another object of the present invention is to provide a trigger apparatus of a light gun in which a trigger system is simplified.

In an aspect of the present invention, a trigger apparatus of a light gun includes a main body, first to third rotation axes, a hammer receiving portion, and first to fourth lever portion. The first to third rotation axes are provided for the main body; a hammer receiving portion is provided in an upper portion of the main body. The first lever portion extends from the main body to the outside of the main body and a trigger operation is carried but to the first lever portion. The second lever portion is rotatably supported by the first rotation axis, and the first lever portion is fixed to the second lever portion. The second lever portion rotates in a counterclockwise direction in response to the trigger operation to the first lever portion. The third lever portion is rotatably supported by the second rotation axis and rotates in a clockwise direction in response to the rotation of the second lever portion. The fourth lever portion is rotatably supported by the third rotation axis and rotates in the counterclockwise direction in response to the rotation of the third lever portion. The first end portion of the third lever portion engages with a first end portion of the fourth lever portion before the trigger operation, and when the third lever portion is rotated in the clockwise direction, the fourth lever portion is released from the engagement and rotates in the counterclockwise direction. A middle portion of the fourth lever portion is provided as a hammer and the hammer hits the hammer receiving portion while the fourth lever portion is rotated.

Here, the trigger apparatus of the light gun may further include a first spring portion which is provided for a first end portion of the second lever portion to apply first spring force to the first end portion of the second lever portion. In this case, the trigger apparatus of the light gun may further include a first member which is provided for the main body; and a first adjusting unit which is provided for a second end portion of the second lever portion to determine an initial position of the second lever portion in relation to the first spring force. Also, the trigger apparatus of the light gun may further include a fixed member which is fixed to the main body; and a stroke adjusting portion which is provided for the second lever portion between the first rotation axis and the first spring portion to determine a stroke of the first lever portion in the trigger operation.

Also, the trigger apparatus of the light gun may further include a second spring portion which is provided for the main body to apply second spring force to the third lever portion such that the first end portion of the third lever portion engages with the first end portion of the fourth lever portion. In this case, trigger apparatus of the light gun may further include a second position adjusting portion which is provided for the main body to adjust the second spring force such that an initial position of the third lever portion is determined.

Also, the trigger apparatus of the light gun may further include a third spring portion which is provided for the main body to apply third spring force to the fourth lever portion such that the fourth lever portion is rotated in the counterclockwise direction. In this case, the trigger apparatus of the light gun may further include a force adjusting portion which is provided for the main body to adjust the third spring force.

Also, the trigger apparatus of the light gun may further include first to third spring portions which bias the second to fourth lever portions, respectively. The first to third spring portions are accommodated in the main body together with the hammer such that the first to third spring portions and the hammer are not exposed.

Also, the first lever portion may further include a trigger blade which is adjustably provided for the first lever portion, and is fixed to the first lever portion in a desired position.

Also, the first lever portion is slidably provided for the second lever portion, and is fixed to the second lever portion in a desired position.

Also, the first lever portion may include a fixed lever portion which is fixed to the second lever portion; and a non-fixed lever portion which is rotatably provided for the fixed lever portion, and is fixed to the fixed lever portion in a desired position.

Also, the trigger apparatus of the light gun may further include a return unit which is provided for the main body to return the fourth lever portion a position before the trigger operation after the trigger operation such that the first end portion of the third lever portion engages with the first end portion of the fourth lever portion.

Also, the fourth lever portion has a hole provided between the third rotation axis and the first end portion thereof, and the hammer receiving portion is desirably replaceable.

In anther aspect of the present invention, a trigger apparatus of a light gun includes a main body, first to third rotation axes, a hammer receiving portion, and first to fourth receiving portions. The first to third rotation axes are provided for the main body. The hammer receiving portion is provided in an upper portion of the main body. The first lever portion extends from the main body to the outside of the main body, and is replaceable, and a trigger operation is carried out to the first lever portion. The second lever portion is rotatably supported by the first rotation axis, and the first lever portion is fixed to the second lever portion. The second lever portion rotates in a counterclockwise direction in response to the trigger operation to the first lever portion. The third lever portion is rotatably supported by the second rotation axis and rotates in a clockwise direction in response to the rotation of the second lever portion. The fourth lever portion is rotatably supported by the third rotation axis and rotates in the counterclockwise direction in response to the rotation of the third lever portion. The return unit is provided for the main body to return the fourth lever portion a position before the trigger operation after the trigger operation such that the first end portion of the third lever portion engages with the first end portion of the fourth lever portion. When the third lever portion is rotated in the clockwise direction, the fourth lever portion is released from the engagement and rotates in the counterclockwise direction, and a middle portion of the fourth lever portion is provided as a hammer and the hammer hits the hammer receiving portion while the fourth lever portion is rotated.

Here, the trigger apparatus of the light gun may further include a first spring portion which is provided for a first end portion of the second lever portion to apply first spring force to the first end portion of the second lever portion; a first member which is provided for the main body; and a first adjusting unit which is provided for a second end portion of the second lever portion to determine an initial position of the second lever portion in relation to the first spring force.

Also, the trigger apparatus of the light gun may further include a fixed member which is fixed to the main body; and a stroke adjusting portion which is provided for the second lever portion between the first rotation axis and the first spring portion to determine a stroke of the first lever portion in the trigger operation. In this case, the trigger apparatus of the light gun may further include a second spring portion which is provided for the main body to apply second spring force to the third lever portion such that the first end portion of the third lever portion engages with the first end portion of the fourth lever portion; and a second position adjusting portion which is provided for the main body to adjust the second spring force such that an initial position of the third lever portion is determined.

Also, the trigger apparatus of the light gun may further include a third spring portion which is provided for the main body to apply third spring force to the fourth lever portion such that the fourth lever portion is rotated in the counterclockwise direction; and a force adjusting portion which is provided for the main body to adjust the third spring force.

Also, the first lever portion further may include a trigger blade which is adjustably provided for the first lever portion, and is fixed to the first lever portion in a desired position.

Also, the first lever portion may include a fixed lever portion which is fixed to the second lever portion; and a non-fixed lever portion which is rotatably provided for the fixed lever portion, and is fixed to the fixed lever portion in a desired position.

Also, the trigger apparatus of the light gun may further include a return unit which is provided for the main body to return the fourth lever portion a position before the trigger operation after the trigger operation such that the first end portion of the third lever portion engages with the first end portion of the fourth lever portion.

Also, the fourth lever portion has a hole provided between the third rotation axis and the first end portion thereof, and the hammer receiving portion is desirably replaceable.

DESCRIPTION OF THE PREFERRED EMBODIMENTS

Hereinafter, a trigger apparatus of a light gun of the present invention will be described with reference to the attached drawings.

Figure 1:
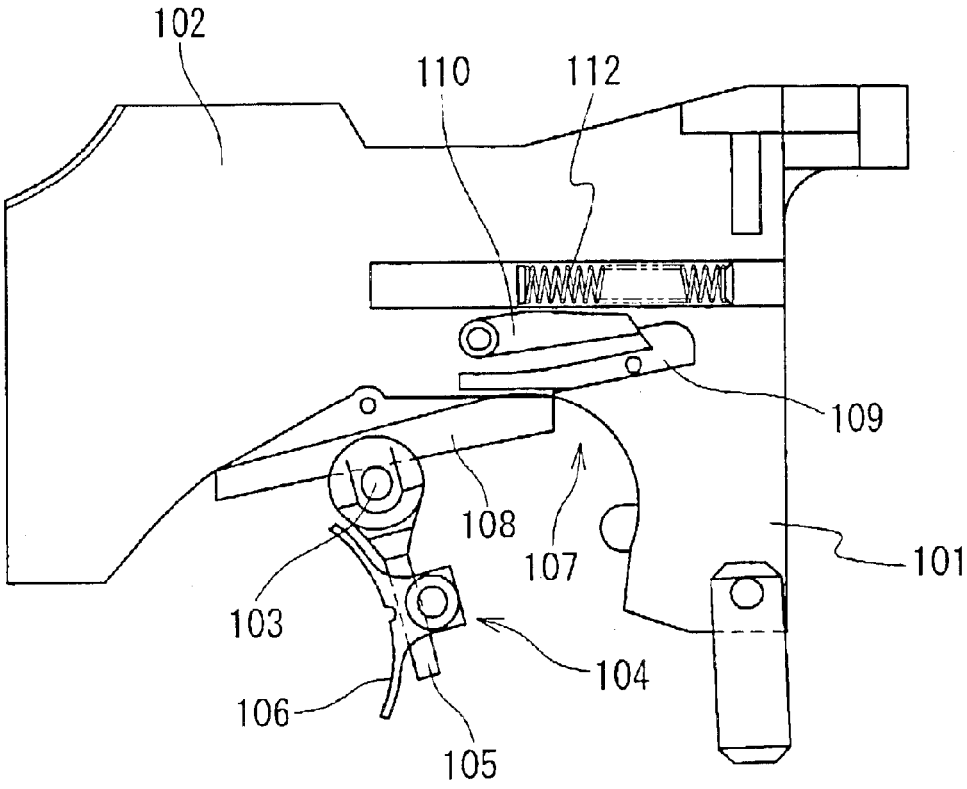
Fig. 1 PRIOR ART
FIG. 1 is a cross sectional view showing a trigger apparatus of a conventional gun for an actual bullet.
Figure 2:
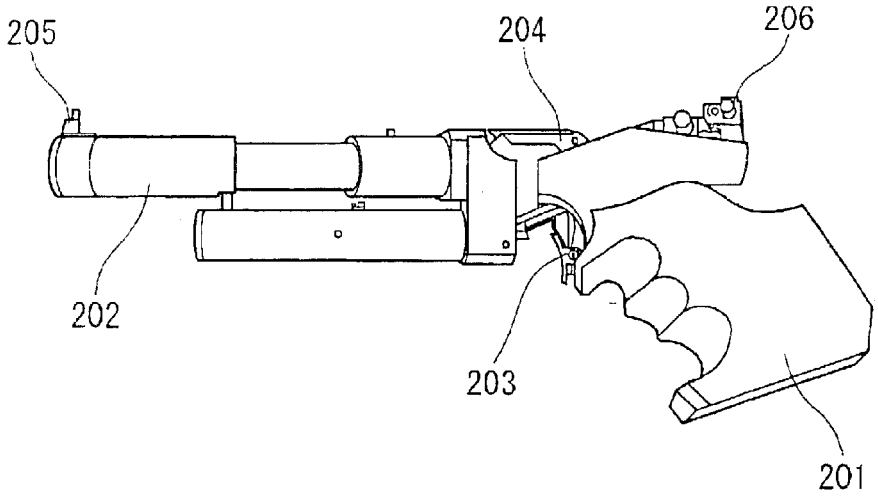
Fig. 2 PRIOR ART
FIG. 2 is a perspective view showing a conventional pistol-type light gun.
Figure 3:
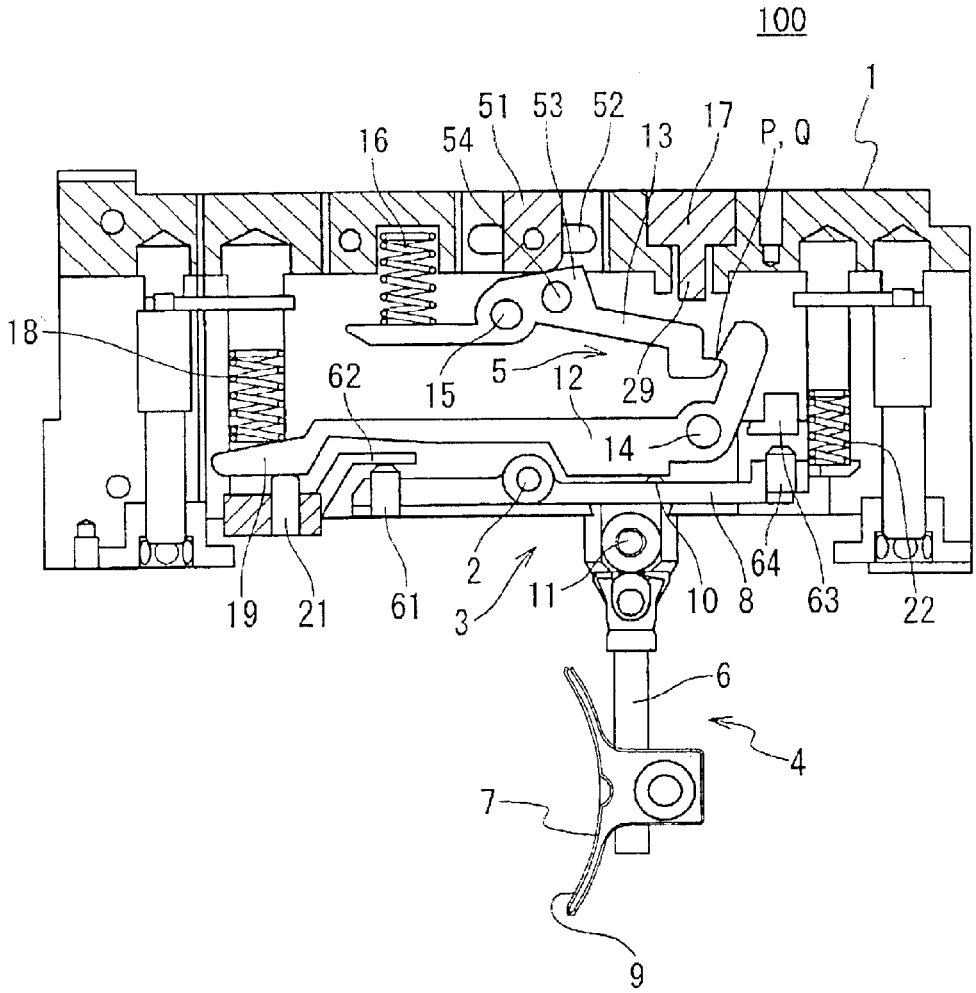
FIG. 3 is a cross sectional view showing a trigger apparatus of a light gun according to an embodiment of the present invention.

FIG. 3 is a side cross sectional view of the trigger apparatus 100 of the light gun according to an embodiment of the present invention. The trigger apparatus 100 is composed of a main body 1, a trigger operation system 3 and a hammer operation system 5 which are arranged in the main body 1 of the trigger apparatus 100 of the light gun.

Figure 4:
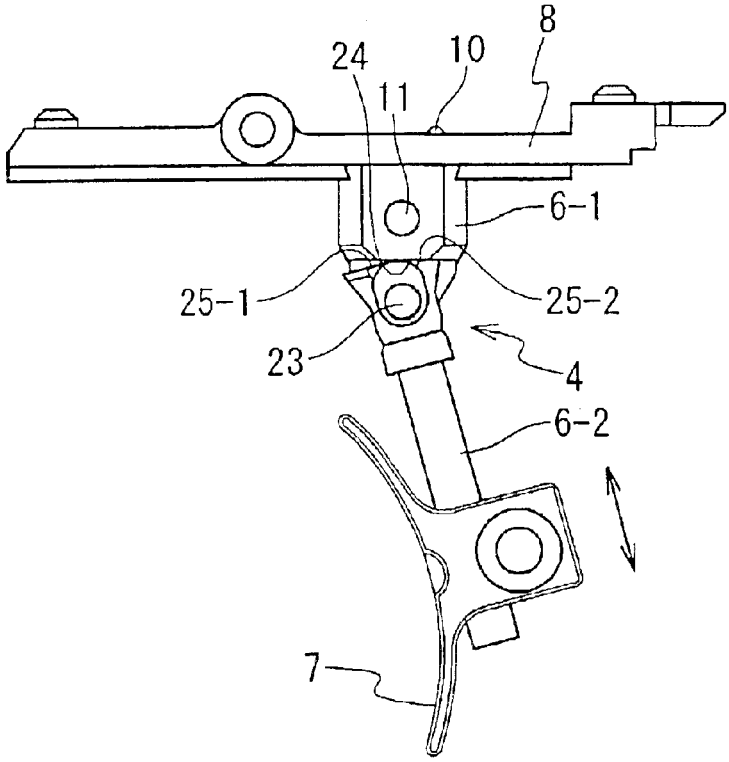
FIG. 4 is a view showing a trigger lever portion for a pistol used in the trigger apparatus according to the embodiment.
Figure 5:
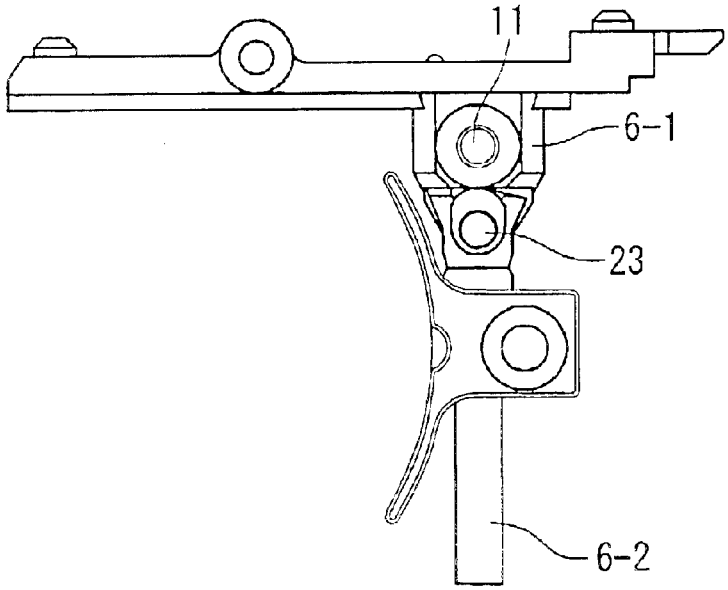
FIG. 5 is a view showing the trigger lever portion for a rifle used in the trigger apparatus according to the embodiment.

The trigger operation system 3 includes a trigger lever portion 4, which includes a first lever portion 6 and a trigger blade 7, and a second lever portion 8. FIGS. 4 and 5 are diagrams showing the trigger lever portion 4. The first lever portion 6 is composed of a fixed lever portion 6-1 and an adjustable lever portion 6-2.

A first rotation axis 2 is fixedly provided for the main body 1 of the trigger apparatus 100. The second lever portion 8 is rotatably supported by the first axis 2. A small projection portion 10 is fixedly provided for the second lever portion 8 on the side of the first lever portion 6 with respect to the first rotation axis 2. The first lever portion 6 of the trigger lever portion 4 is provided to be slidable with respect to the second lever portion 8. The first lever portion 6 is fixed to the second lever portion 8 after the first lever portion 6 is set to a desired position. Thus, a rotation radius from the first rotation axis 2 to a coupling point of the first lever portion 6 and the second lever portion 8 is option and variable. The trigger blade 7 is provided for the first lever portion 6 to be slidable. The trigger blade 7 is fixed to the first lever portion 6 after the trigger blade 7 is set to a desired position. The trigger blade 7 has a finger hanging surface 9. In this way, when the trigger blade 7 is pulled by a finger of a shooter, the second lever portion 8 rotates around the first rotation axis 2 in a counterclockwise direction.

The hammer operation system 5 operates in conjunction with the trigger operation system 3. The hammer operation system 3 is composed of a third lever portion 12 and a fourth lever portion 13 operating in conjunction with the third lever portion 12. A second rotation axis 14 and a third rotation axis 15 are fixedly provided for the main body 1 of the trigger apparatus 100. The third lever portion 12 is rotatably supported by the second rotation axis 14, and the fourth lever portion 13 is rotatably supported by the third rotation axis 15.

The second lever portion 8 contacts the third lever portion 12 by the small local projection 10. When the trigger blade 7 is pulled by the finger of the shooter, the third lever portion 12 is pushed by the small local projection 10 and rotates around the second rotation axis 14 in a clockwise direction, since the second lever portion 8 rotates around the first rotation axis 2 in the counterclockwise direction.

An operation end of the third lever portion 12 is P, and an operation end of the fourth lever portion 13 is Q. The operation end P of the third lever portion 12 and the operation end Q of the fourth lever portion 13 engage with each other. The rotation operation of the fourth lever portion 13 is stopped or constrained by the third lever portion 12. When the third lever portion 12 rotates by a small angle in the clockwise direction, the fourth lever portion 13 is released from the engagement with the second lever portion 12 and rotates in the counterclockwise direction in a moment. The fourth lever portion 13 itself or a portion thereof functions as a rotation hammer.

A hammer receiving stopper 17 is provided for the main body 1 of the trigger apparatus 100 on a position opposing to the fourth lever portion 13 rotated in the counterclockwise direction. Before the trigger operation starts, the operation ends P and Q are in the engagement state and exist in the same point or same region. However, when the third lever portion 12 is rotated by a small angle into the clockwise direction, the operation end P moves to an angular position in the clockwise direction and the engagement state with the operation end Q is canceled. As a result, the fourth lever 13 rotates into the counterclockwise direction, and strongly hits the hammer receiving stopper 17.

The force with which rotates the fourth lever portion 13 in the counterclockwise direction is generated by a trigger spring 16 and acts on the other end of the fourth lever portion 13 to rotate the fourth lever portion 13 in the counterclockwise direction. One end portion of the trigger spring 16 is fixed to the main body 1 through a spring force adjustment screw (not illustrated) as a spring force adjustment member. The other end portion of the trigger spring 16 is fixed to the other operation end of the fourth lever portion 13. The magnitude of the force can be adjusted by the spring force adjustment screw provided for a top portion of the trigger spring 16. The magnitude of the force may be changed through the replacement by the trigger spring 16 with different spring force. Through the adjustment of the trigger spring force, the adjustment of speed and strength when the fourth lever portion 13 strikes on the hammer reception stopper 17 can be made possible.

When the finger of the shooter contacting the finger hanging surface 9 of the trigger blade 7 is pulled on the body side of the shooter, the first lever portion 6 rotates in the counterclockwise direction. At this time, the second lever portion 8 rotates in the counterclockwise direction in conjunction with the trigger operation, and the small projection portion 10 pushes the third lever portion 12. Since the small projection portion 10 is provided on the left side from the second rotation axis 14, the third lever 12 is pushed by the small projection portion 10 and rotates in the clockwise direction. Thus, the engagement of the operation end P and the operation end Q is eliminated or canceled, the fourth lever portion 13 is released from the rotation stop force from the third lever portion 12. At this time, the fourth lever portion 13 receives the trigger force equivalent to the spring force of the trigger spring 16 and rotates in the counterclockwise direction. The fourth lever portion 13 strongly hits the lower portion of the hammer receiving stopper 17. In this way, the fourth lever portion 13 functions as a rotary hammer.

A rotation force is always applied to the other operation end of the third lever portion 12 as a rotation bias force for engaging the operation end portion P with the operation end portion Q. In order to apply the rotation bias force to the third lever portion 12, a bias spring 18 is provided for the main body 1. One end of the bias spring 18 is fixed to the main body 1 of the trigger apparatus 100 and the other end of the bias spring 18 is fixed to the other operation end 19 of the third lever portion 12 to push the operation end 19. Thus, the third lever portion 12 is always biased to rotate into the counterclockwise direction by the bias spring 18.

The initial position of the operation end P of the third lever portion 12 before the trigger operation starts is adjusted by an initial position adjustment screw 21. The initial position adjustment screw 21 is arranged at a lower portion of the main body 1 of the trigger apparatus 100. When the initial position adjustment screw 21 is rotated into a clockwise direction, the initial position adjustment screw 21 moves toward the operation end 19 of the third lever 12 and the third lever portion 12 rotates in the clockwise direction. If the initial position adjustment screw 21 is rotated in the clockwise direction by a predetermined rotation angle, the operation end point P is released from the engagement with the operation end Q of the fourth lever 13 and the operation end Q of the fourth lever portion 13 becomes free.

When the initial position adjustment screw 21 is rotated in the counterclockwise direction, the initial position adjustment screw 21 retreats so that the operation end 19 of the third lever portion 12 rotates in the counterclockwise direction. When the initial position adjustment screw 21 is rotated in the counterclockwise direction by a larger angle, the operation end P moves more toward the operation end Q. The engagement quantity of the third lever portion 12 and the fourth lever portion 13 becomes further larger. By adjusting a rotation quantity of the initial position adjustment screw 21 in the clockwise and counterclockwise directions, the movement quantity of the trigger blade 7 in the trigger operation can be finely adjusted.

It should be noted that a member may be added to change the spring length for the adjustment of the rotation bias force by the bias spring 18. As such a member, a pushing bar may be exemplified which can move linearly in a spring axis direction in conjunction with a handle rotatably supported by the main body 1 of the trigger apparatus 100.

The operation force of the trigger lever portion 4 can be adjusted by an adjustment spring 22 which is arranged in the main body 1 of the trigger apparatus 100 to push a one end portion of the second lever portion 8. The operation force of the adjustment spring 22 influences the trigger operation force. An initial position determining member 62 is fixedly and firmly provided for the main body 1 of the trigger apparatus 100. The initial position determining member 62 may have an elastic property. Also, an initial position adjustment screw 61 is provided rotatably for the main body 1 of the trigger apparatus 100. The clockwise direction rotation of the initial position adjustment screw 61 rotates the one operation end of the second lever portion 8 in the clockwise direction and the counterclockwise direction rotation of the initial position adjustment screw 61 rotates the operation end of the second lever portion 8 in the counterclockwise direction. Such a rotation of the second lever portion 8 determines the operation staring point of the first lever portion 6. Thus, by the operation force of the adjustment spring 22 and by the pushing force of the initial position adjustment screw 61 to the initial position determining member 62, the first lever portion 4 is stabilized on the initial position before the trigger operation starts.

A portion 63 shown in FIG. 3 is a trigger pulling quantity determining terminal which defines a rotation limitation of the second lever portion 8 in the counterclockwise direction. An adjustment screw 64 is provided for the second lever portion 8. A distance between the adjustment screw 64 and the terminal 63 can be adjusted by adjusting the rotation of the adjustment screw 64. The trigger pulling quantity of the first lever portion 6 is defined based on the rotation of a pulling quantity adjustment screw 64 which is forced into the operation end of the second lever portion 8 on the side of the spring 22.

It should be noted that the initial position determining member 62 may be rigid plate. Also, it is desirable that the trigger spring 16, the bias spring 18, and the adjustment spring 22 are arranged so that they can be adjusted after installing a barrel unit and/or a grip. Through the arrangement, it is possible to adjust the trigger operation and the trigger reaction while ascertaining the feel of the trigger.

Figure 20:
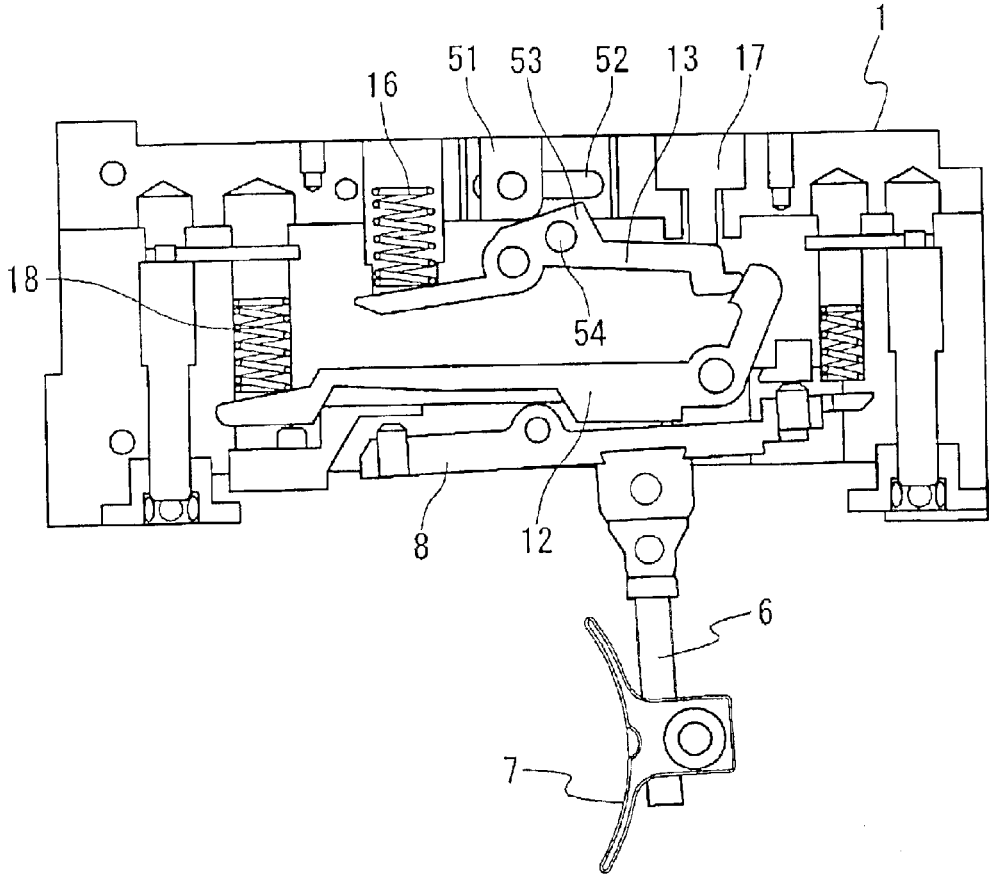
FIG. 20 is a diagram showing an operation of a return unit.

Referring to FIGS. 3 and 20, a return unit 51 is guided in a direction from the front side to the rear side in a guidance ditch 52 provided for the main body 1 of the trigger apparatus 100. The return unit 51 is manually returned to an original position after its operation. As shown in FIG. 20, when the trigger operation is carried out, the fourth lever portion 13 is released from the third lever portion 12 and rotates into the counterclockwise direction. At the same time, the return unit 51 goes ahead into the target. Then, by pulling the return unit 51 to the side close to the shooter, the return unit 51 pushes down a bulge portion 53 of the fourth lever portion 13 to rotate the fourth lever portion 13 in the clockwise direction. The operation end Q of the fourth lever portion 13 rotates in the clockwise direction, contacts the operation end P of the third lever portion 12, and engages with the operation end P again. The return unit 51 may be modified to carry out a rotary operation. In this case, the rotary return unit pushes down the bulge portion 53 of the fourth lever portion 13 in the clockwise direction to rotate it.

By the spring operation to rotate the third lever portion 12 in the clockwise direction and the spring operation to rotate the fourth lever portion 13 in the counterclockwise direction, the third lever portion 12 returns to the original rotation position before the trigger operation, as shown in FIG. 3. Thus, the third lever portion 12 and the fourth lever portion 13 engage with each other.

It is important to provide a hole 54 for the bulge portion 53. It is possible to increase the rotation acceleration of the fourth lever portion 13 by the spring 16 by providing such a hole 54. The time until the hammer portion of the fourth lever portion 13 hits the hammer receiving stopper 17 becomes shorter and the hammer portion hits the stopper 17 at faster speed. The impact becomes larger based on the acceleration in the short distance.

FIG. 4 shows a gun mode switching in the trigger lever portion 4. As described above, the trigger lever portion 4 is slid with respect to the second lever portion 8 and fixed to it by a bolt inserted into a fourth axis 11. The first lever portion 6 is composed of the fixed lever portion 6-1 and the adjustable lever portion 6-2. The adjustable lever portion 6-2 is rotatably coupled with the fixed lever portion 6-1 through a switching axis 23. The first surface 24 of the fixed lever portion 6-1 is formed as a lower surface of the fixed lever portion 6-1 to oppose to the adjustable lever portion 6-2. It is proper that the first surface 24 has a plane or a spherical surface with a little given curvature.

The second surface 25 is formed on the adjustable lever portion 6-2 to oppose to the first surface 24 of the fixed lever portion 6-1. It is proper that the second surface 25 is a composition of a first slope portion 25-1 and a second slope portion 25-2. The first slope portion 25-1 and the second slope portion 25-2 may be formed as the spherical surface coincident with the previously mentioned spherical surface. The first slope portion 25-1 and the second slope portion 25-2 are separated from each other with respect to the switching axis 23 as a center. By rotating the adjustable lever portion 6-2 in the counterclockwise direction forcefully with respect to the fixed lever portion 6-1, the adjustable lever portion 6-2 can be angularly displaced between a first rotation position on which the first slope portion 25-1 contacts the first surface 24 and a second rotation position where the second slope portion 25-2 contacts the first surface 24. When the adjustable lever portion 6-2 is located on the second rotation position shown in FIG. 4, the light gun is used as a pistol. When the adjustable lever portion 6-2 is located on the first rotation position shown in FIG. 5, the light gun is used as a rifle. The switching axis 23 is tightened and the adjustable lever portion 6-2 is fixed to the fixed lever portion 6-1. Thus, the first rotation position and the second rotation position can be stably fixed. Such a 2-position switching mechanism is not limited to the forced rotation and is replaced with the bolt tightening after free rotation.

Figure 6:
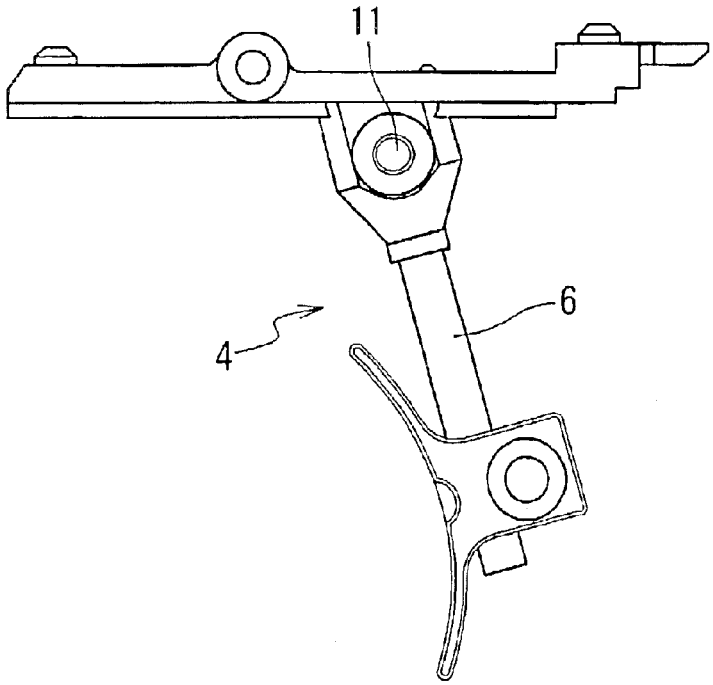
FIG. 6 is a view showing a trigger lever portion for a pistol used in a modification of the trigger apparatus according to the embodiment.
Figure 7:
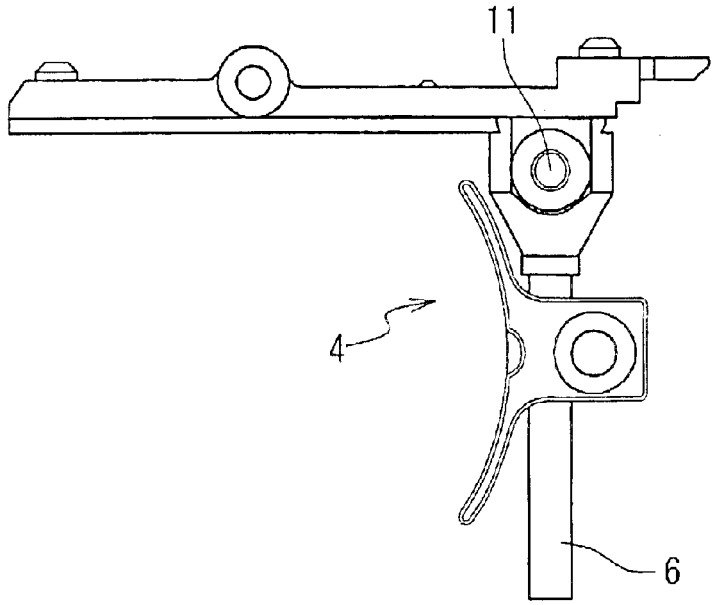
FIG. 7 is a view showing the trigger lever portion for a rifle used in a modification of the trigger apparatus according to the embodiment.

FIG. 6 and FIG. 7 show another gun mode switching in the trigger lever portion 4. The first lever portion 6 shown in FIG. 6 is made to have a shape of a pistol exclusive use type, and the first lever portion 6 shown in FIG. 7 is made to have a shape of a rifle exclusive use type. The first lever portion 6 of the pistol exclusive use type and the first lever portion 6 of the rifle exclusive use type are detachable from the fourth rotation axis 11. The first lever portion 6 of the rifle exclusive use type extends into the direction orthogonal to the center axis of a barrel unit (not shown). The first lever portion 6 of the pistol exclusive use type extends for its bottom portion to come close to the body of the shooter diagonally with respect to the axis of the barrel unit.

Figure 8:
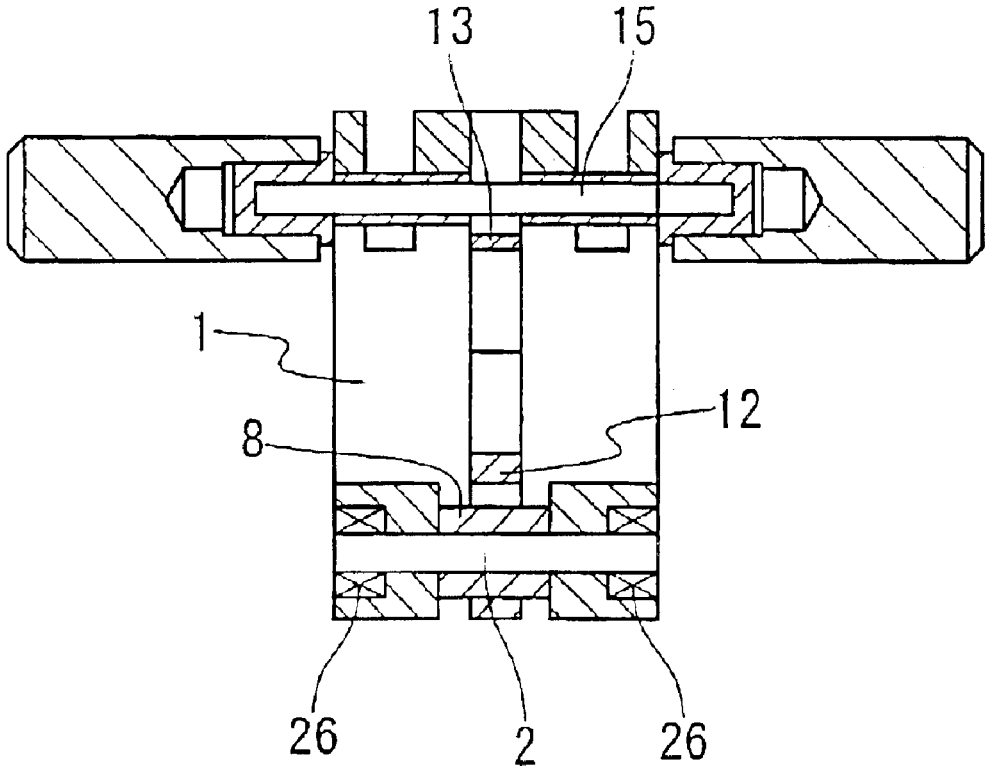
FIG. 8 is a cross sectional view when the trigger apparatus is cut by a plane orthogonal to the center axis of a barrel unit containing a first rotation axis.

FIG. 8 is a cross sectional view when the trigger apparatus 100 is cut by a plane orthogonal to the center axis of the barrel unit containing the first rotation axis 2. The trigger apparatus 100 is shown to have a both side wall forming housing in the cross sectional view of FIG. 8. The third lever portion 12 and the fourth lever portion 13 are attached between two opposing surfaces of the walls of the both side wall forming housing. A circular cylinder portion of the second lever portion 8 supported by the first rotation axis 2 is shown in FIG. 8. The first rotation axis 2 is coaxially inserted into the circular cylinder portion of the second lever portion 8. Two ball bearings 26 are put into each of the walls of the both side wall forming housing and are fixed thereto. The both edge portions of the first rotation axis 2 are rotatably supported by the two ball bearings 26. The second lever portion 8 can be rotated to the trigger apparatus 100 together with the first rotation axis 2.

Figure 9:
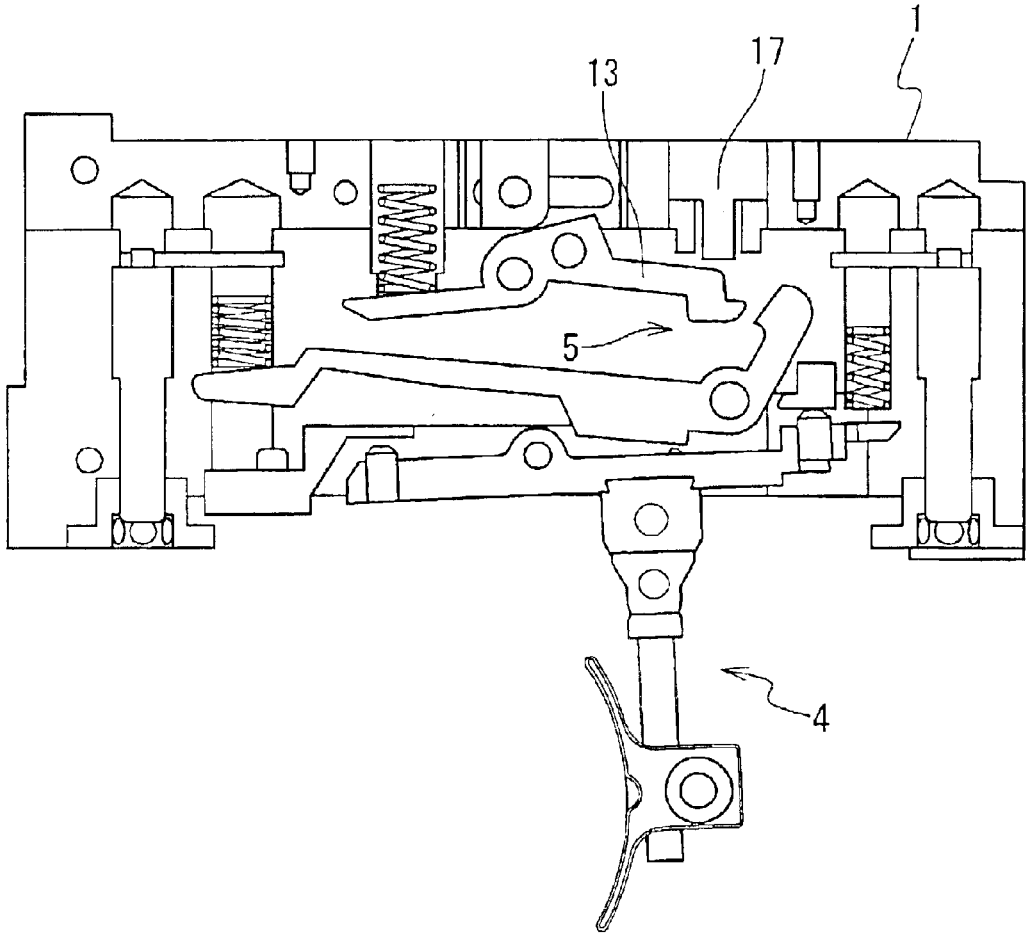
FIG. 9 shows a position relation of a fourth lever portion and a hammer receiving stopper when the fourth lever portion hits the hammer receiving stopper.
Figure 10:
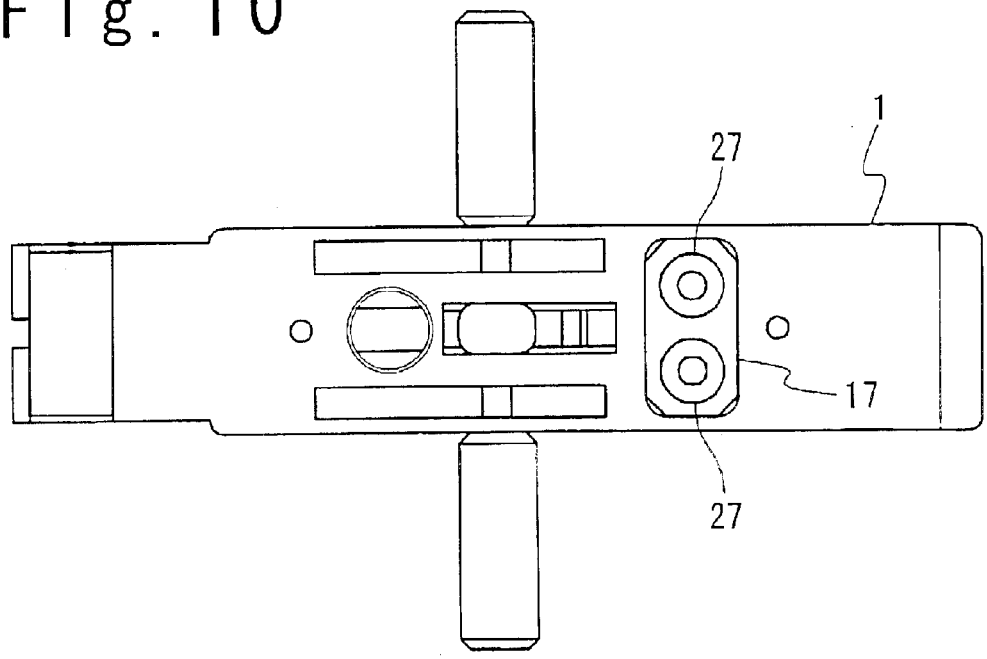
FIG. 10 is a plan view of the trigger apparatus according to the embodiment of the present invention.
Figure 11:
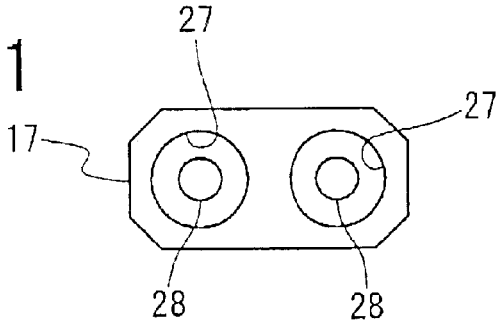
FIG. 11 is a plan view showing a hammer receiving stopper.

FIG. 9 shows a position relation of the fourth lever portion 13 and the hammer receiving stopper 17 when the fourth lever portion 13 hits the hammer receiving stopper 17. The hammer receiving stopper 17 is put into a hole formed on the upper portion of the trigger apparatus 100, as shown in FIG. 10. Two bolt head engagement holes are formed on the upper portion of the hammer receiving stopper 17 for the two bolt head to go into them, as shown in FIG. 11. The screw holes 28 are formed to extend downwardly from the bottoms of the two bolt head engagement holes 27, into the direction of the operation end Q of the fourth lever portion 13. Bolts (not shown) are forced into the two screw holes 28 so that the hammer receiving stopper 17 is firmly fixed to the trigger apparatus 100.

As shown in FIG. 10, the hammer receiving stopper 17 is composed of a hammer receiving stopper main body portion 29 and a head portion. The lower end surface of the head portion 30 positions the lower end surface of the hammer receiving stopper main body portion 29. The hammer receiving stopper main body portion 29 is located on a center position into the direction orthogonal to the center axis of the barrel unit. The hammer receiving stopper main body portion 29 is formed as a circular column body or a square column body. An upper portion of the fourth lever portion 13 strongly hits the lower end surface of the hammer receiving stopper main body portion 29, when the trigger operation is carried out.

Figure 12:
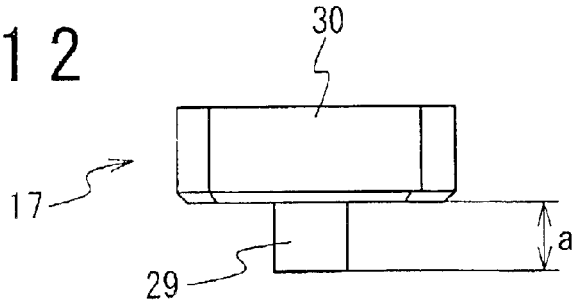
FIG. 12 is a side view showing the hammer receiving stopper.

As shown in FIG. 12, the hammer receiving stopper main body portion 29 can be cut to make it possible to adjust the length a. A plurality of types of hammer receiving stoppers 17 may be prepared. By replacing the type of hammer receiving stopper 17 by another one and attaching it to the trigger apparatus 100, an initial distance between the collision surface of the fourth lever portion 13 and a collision surface of the lower end surface of the hammer receiving stopper main body portion 29 before the trigger operation start can be adjusted. By adjusting the length a, the magnitude of the impact in case of the trigger operation can be adjusted.

Figures 13A, 13B:
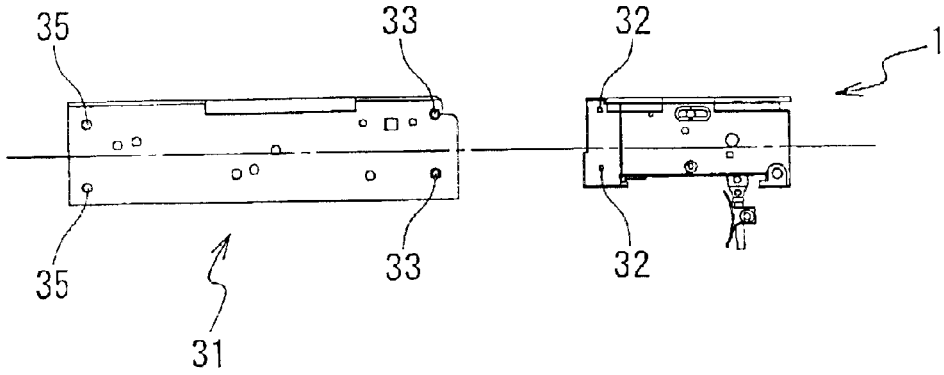
FIGS. 13A and 13B are diagrams showing a barrel unit and the trigger apparatus, respectively.

FIGS. 13A and 13B show a barrel unit 31 and the trigger apparatus 100, respectively. The trigger apparatus 100 functions as a basic unit. The barrel unit 31 is attached to the basic unit 1. A plurality of first coupling holes 32 are arranged in the front region of the basic unit 1. A plurality of second coupling holes 33 are arranged in the rear region of the barrel unit 31. The barrel unit 31 is engaged with the basic unit or main body 1 such that front portion of the basic unit 1 is inserted into the rear portion of the barrel unit 31 until the first coupling holes 32 and the second coupling holes 33 are coincident with each other in position. One of the first coupling holes 32 and the second coupling hole 33 is screw holes. The screws are passed through the first coupling holes 32 and the second coupling holes 33, are screwed to couple the barrel unit 31 to the basic unit 1.

Figure 14:
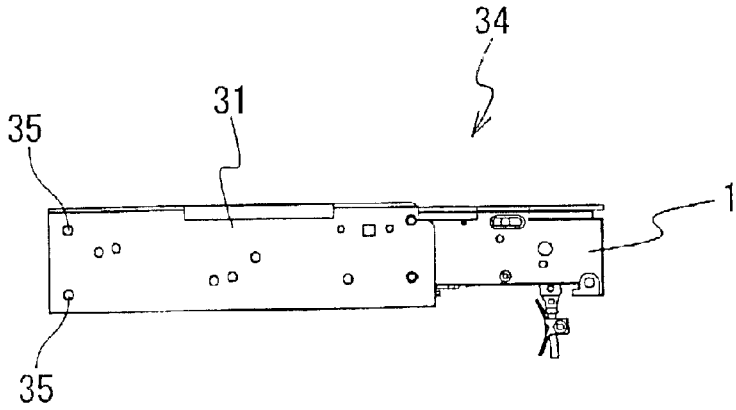
FIG. 14 is a diagram showing a basic main body in which a basic unit and the barrel unit are coupled and assembled.

FIG. 14 shows a basic main body 34 in which the basic unit 1 and the barrel unit 31 are coupled and assembled. The basic main body 34 is used for a rifle and a pistol. A plurality of third coupling holes 35 are arranged in the front region of the basic main body 34, i.e., the front region of the barrel unit 31.

Figure 15:
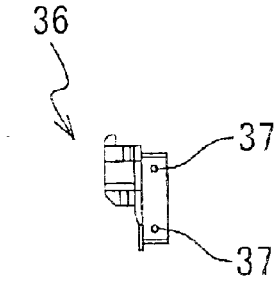
FIG. 15 is a diagram showing a front gun sight for a pistol.
Figure 16:
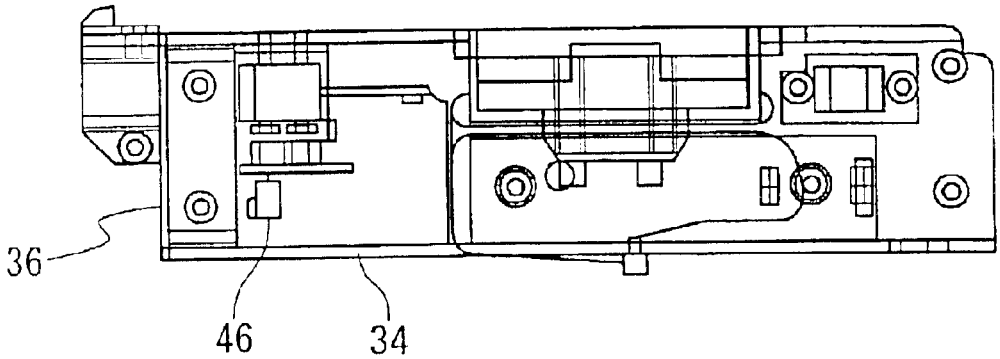
FIG. 16 is a diagram showing the pistol in which the basic main body and a front gun sight for the pistol are coupled and assembled.

FIG. 15 shows a front gun sight 36 for the pistol. A plurality of fourth coupling holes 37 are arranged in the rear region of the front gun sight 36 for the pistol. The rear portion of the front sight 36 for the pistol is inserted in the front portion of the basic main body 34 or the barrel unit 31 until the third coupling holes 35 and the fourth coupling holes 37 are coincident with each other in position. Either of the third coupling holes 35 and the fourth coupling holes 37 are screw holes. The screws are passed through the third coupling hole 35 and the fourth coupling hole 37, are screwed and the front sight 36 for the pistol are coupled to the basic main body 34. FIG. 16 shows the pistol in which the basic main body 34 and the front gun sight 36 for the pistol are coupled and assembled. Moreover, a dressed body is added to the basic main body 34.

As shown in FIG. 16, an infrared ray light receiving unit 46 is provided for the front region of the basic main body 34. The infrared ray light receiving unit 46 receives an infrared digital signal which is radiated from the side of a target. The infrared digital signal is a signal for establishing the correspondence between the target and the light gun. The infrared ray light receiving unit 46 is also provided for the extension barrel 38 for the rifle.

Figure 17:
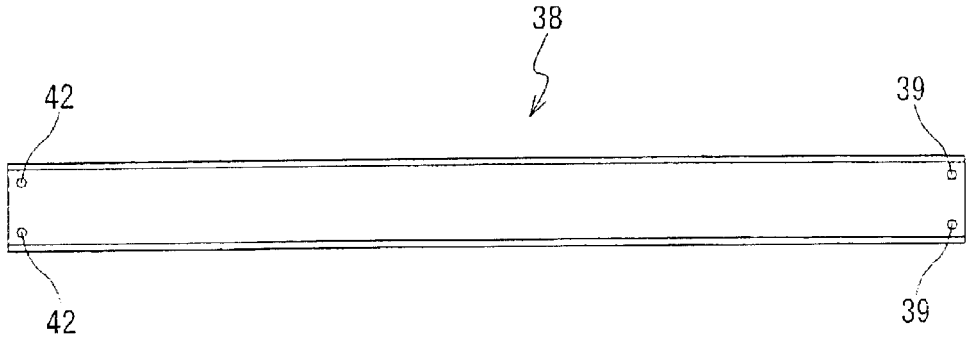
FIG. 17 is a diagram showing an extension barrel for the rifle.

FIG. 17 shows an extension barrel 38 for the rifle. A plurality of fifth coupling holes 39 are arranged in the rear region of the extension barrel 38 for the rifle. The rear portion of the extension barrel 38 for the rifle is inserted in the front portion of the basic main body 34 until the third coupling holes 35 of the basic main body 34 and the fifth coupling holes 39 meet with each other in position. Either of the fifth coupling holes 39 and the third coupling holes 35 are screw holes. The screws are passed through the fifth coupling holes 39 and the third coupling holes 35, are screwed and the extension barrel 38 for the rifle is coupled with the basic main body 34.

Figure 18:
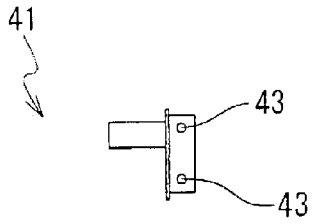
FIG. 18 is a diagram showing a front gun sight for a rifle.
Figure 19:
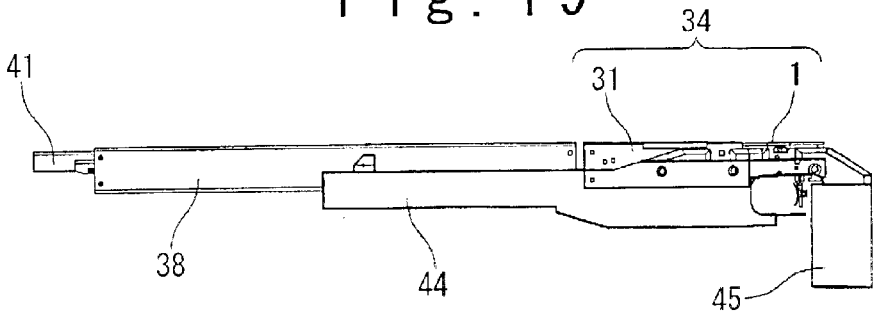
FIG. 19 is a diagram showing the rifle in which a front gun sight for the rifle and the extension barrel for the rifle are coupled with the basic main body.

FIG. 18 shows a front gun sight 41 for the rifle. Sixth coupling holes 42 are arranged in the front region of the extension barrel 38 for the rifle. A plurality of seventh coupling holes 43 are arranged in the rear region of the front gun sight 41 for the rifle. The rear portion of the front sight 41 for the rifle is inserted into the front portion of the extension barrel 38 for the rifle until the sixth coupling holes 42 of the extension barrel 38 and seventh coupling holes 43 meet with each other in position. Either of the seventh coupling holes 43 and the sixth coupling holes 42 are screw holes. The screws are passed through the seventh coupling holes 43 and the sixth coupling holes 42, are screwed and the front gun sight 41 for the rifle is coupled with the extension barrel 38 for the rifle. FIG. 19 shows the rifle in which the front gun sight 41 for the rifle and the extension barrel 38 for the rifle are coupled with the basic main body 34. Moreover, a dressed body 44 and a grip 45 are added.

Material of each portion of the light gun is as follows.

Main body 1: Al
First lever portion 6: SUM24L
Trigger blade 7: Al
Second lever portion 8: Al
First reception side lever 12: SKD4
Second reception side lever 13: SKD4
Hammer receiving stopper 17: SKD4

Light weight metal (exemplified as Al) is suitable for the main body of the trigger apparatus 100 to lighten of the gun. It is desirable that the third lever portion 12 and the fourth lever portion 13 which have friction contact with each other are formed of same hard material so that they can move and slide smoothly. For example, SKD4 as alloy tool steel is suitable. It is desirable that the fourth lever portion 13 and the hammer receiving stopper 17 which hit to each other are formed of same hard material, for example, SKD4. SKD4 is excellent in workability and a hardening process and is the optimal in the rigidity after hardening. As the material of the first lever portion 6, SUM24 is suitable because it is excellent in the strength and the workability.

A plurality of springs 16, 18, and 22 can be accommodated in the housing which forms the main body 1 of the trigger apparatus 100. The gun for the actual bullet which is rigidly made has a hole for the lightening. A hole is opened around the hammer and a spring is exposed there. However, the main body 1 of the trigger apparatus 100 of the light gun according to the present invention is light, and stores springs in the housing completely and the human body does not touch any springs and moreover the human body does not touch the hammer.

In the trigger apparatus of the light gun according to the present invention, the hammer is rotated to simplify the structure of the trigger system. Thus, the trigger operation to the shooting can be improved and moreover by deleting the hammer of the gun, the lightening can be realized.

What is claimed is:

1. A trigger apparatus of a gun that projects light, comprising:

a main body;

first to third rotation axes which are provided for said main body;

a hammer receiving portion provided in an upper portion of said main body;

a first lever portion which extends from said main body to the outside of said main body and to which a trigger operation is carried out;

a second lever portion which is rotatably supported by said first rotation axis, and to which said first lever portion is fixed, said second lever portion rotating in a counterclockwise direction in response to said trigger operation to said first lever portion;

a third lever portion which is rotatably supported by said second rotation axis and rotates in a clockwise direction in response to the rotation of said second lever portion; and a fourth lever portion which is rotatably supported by said third rotation axis and rotates in the counterclockwise direction in response to the rotation of said third lever portion, wherein a first end portion of said third lever portion engages with a first end portion of said fourth lever portion before said trigger operation, when said third lever portion is rotated in the clockwise direction, said fourth lever portion is released from the engagement and rotates in the counterclockwise direction, and a middle portion of said fourth lever portion is provided as a hammer and said hammer hits said hammer receiving portion while said fourth lever portion is rotated.

2. The trigger apparatus of the gun according to claim 1, further comprising:

a first spring portion which is provided for a first end portion of said second lever portion to apply first spring force to the first end portion of said second lever portion.

3. The trigger apparatus of the gun according to claim 2, further comprising:

a first member which is provided for said main body; and a first adjusting unit which is provided for a second end portion of said second lever portion to determine an initial position of said second lever portion in relation to said first spring force.

4. The trigger apparatus of the gun according to claim 2, further comprising:

a fixed member which is fixed to said main body; and a stroke adjusting portion which is provided for said second lever portion between said first rotation axis and said first spring portion to determine a stroke of said first lever portion in said trigger operation.

5. The trigger apparatus of the gun according to claim 2, further comprising:

a return unit which is provided for said main body to return said fourth lever portion a position before said trigger operation after said trigger operation such that said first end portion of said third lever portion engages with said first end portion of said fourth lever portion.

6. The trigger apparatus of the gun according to claim 1, further comprising:

a second spring portion which is provided for said main body to apply second spring force to said third lever portion such that said first end portion of said third lever portion engages with said first end portion of said fourth lever portion.

7. The trigger apparatus of the gun according to claim 6, further comprising:

a second position adjusting portion which is provided for said main body to adjust said second spring force such that an initial position of said third lever portion is determined.

8. The trigger apparatus of the gun according to claim 1, further comprising:

a third spring portion which is provided for said main body to apply third spring force to said fourth lever portion such that said fourth lever portion is rotated in the counterclockwise direction.

9. The trigger apparatus of the gun according to claim 8, further comprising:

a force adjusting portion which is provided for said main body to adjust said third spring force.

10. The trigger apparatus of the gun according to claim 1, further comprising:

first to third spring portions which bias said second to fourth lever portions, respectively, wherein said first to third spring portions are accommodated in said main body together with said hammer such that said first to third spring portions and said hammer are not exposed.

11. The trigger apparatus of the gun according to claim 1, wherein said first lever portion further comprises:

a trigger blade which is adjustably provided for said first lever portion, and is fixed to said first lever portion in a desired position.

12. The trigger apparatus of the gun according to claim 1, wherein said first lever portion is slidably provided for said second lever portion, and is fixed to said second lever portion in a desired position.

13. The trigger apparatus of the gun according to claim 1, wherein said first lever portion comprises:

a fixed lever portion which is fixed to said second lever portion; and a non-fixed lever portion which is rotatably provided for said fixed lever portion, and is fixed to said fixed lever portion in a desired position.

14. The trigger apparatus of the gun according to claim 1, further comprising:

a return unit which is provided for said main body to return said fourth lever portion a position before said trigger operation after said trigger operation such that said first end portion of said third lever portion engages with said first end portion of said fourth lever portion.

15. The trigger apparatus of the gun according to claim 1, wherein said fourth lever portion has a hole provided between said third rotation axis and said first end portion thereof.

16. The trigger apparatus of the gun according to claim 1, wherein said hammer receiving portion is replaceable.

17. A trigger apparatus of a gun that projects light, comprising:

a main body;

first to third rotation axes which are provided for said main body;

a hammer receiving portion provided in an upper portion of said main body;

a first lever portion which extends from said main body to the outside of said main body, and is replaceable, and to which a trigger operation is carried out;

a second lever portion which is rotatably supported by said first rotation axis, and to which said first lever portion is fixed, said second lever portion rotating in a counterclockwise direction in response to said trigger operation to said first lever portion;

a third lever portion which is rotatably supported by said second rotation axis and rotates in a clockwise direction in response to the rotation of said second lever portion;

a fourth lever portion which is rotatably supported by said third rotation axis and rotates in the counterclockwise direction in response to the rotation of said third lever portion; and a return unit which is provided for said main body to return said fourth lever portion a position before said trigger operation after said trigger operation such that said first end portion of said third lever portion engages with said first end portion of said fourth lever portion, wherein when said third lever portion is rotated in the clockwise direction, said fourth lever portion is released from the engagement and rotates in the counterclockwise direction, and a middle portion of said fourth lever portion is provided as a hammer and said hammer hits said hammer receiving portion while said fourth lever portion is rotated.

18. The trigger apparatus of the gun according to claim 17, further comprising:

a first spring portion which is provided for a first end portion of said second lever portion to apply first spring force to the first end portion of said second lever portion;

a first member which is provided for said main body; and a first adjusting unit which is provided for a second end portion of said second lever portion to determine an initial position of said second lever portion in relation to said first spring force.

19. The trigger apparatus of the gun according to claim 18, further comprising:

a fixed member which is fixed to said main body; and a stroke adjusting portion which is provided for said second lever portion between said first rotation axis and said first spring portion to determine a stroke of said first lever portion in said trigger operation.

20. The trigger apparatus of the gun according to claim 17, further comprising:

a second spring portion which is provided for said main body to apply second spring force to said third lever portion such that said first end portion of said third lever portion engages with said first end portion of said fourth lever portion; and a second position adjusting portion which is provided for said main body to adjust said second spring force such that an initial position of said third lever portion is determined.

21. The trigger apparatus of the gun according to claim 17, further comprising:

a third spring portion which is provided for said main body to apply third spring force to said fourth lever portion such that said fourth lever portion is rotated in the counterclockwise direction; and a force adjusting portion which is provided for said main body to adjust said third spring force.

22. The trigger apparatus of the gun according to claim 17, wherein said first lever portion further comprises:

a trigger blade which is adjustably provided for said first lever portion, and is fixed to said first lever portion in a desired position.

23. The trigger apparatus of the gun according to claim 17, wherein said first lever portion comprises:

a fixed lever portion which is fixed to said second lever portion; and a non-fixed lever portion which is rotatably provided for said fixed lever portion, and is fixed to said fixed lever portion in a desired position.

24. The trigger apparatus of the gun according to claim 17, wherein said fourth lever portion has a hole provided between said third rotation axis and said first end portion thereof.

25. The trigger apparatus of the gun according to claim 17, wherein said hammer receiving portion is replaceable.

* * * * *